US012559931B2

(12) United States Patent
Heidolf et al.

(10) Patent No.: US 12,559,931 B2
(45) Date of Patent: Feb. 24, 2026

(54) DEVICE FOR THERMALLY INSULATING, FORCE-TRANSMITTING RETROFITTING OF A SECOND LOAD-BEARING CONSTRUCTION ELEMENT TO A FIRST LOAD-BEARING CONSTRUCTION ELEMENT AND STRUCTURE WITH SUCH A DEVICE

(71) Applicant: Leviat GmbH, Langenfeld (DE)

(72) Inventors: Thorsten Heidolf, Weimar (DE); Lutz Hollerbuhl, Sangerhausen (DE); Tina Keller, Querfurt (DE)

(73) Assignee: Leviat GmbH, Langenfeld (DE)

( * ) Notice: Subject to any disclaimer, the term of this patent is extended or adjusted under 35 U.S.C. 154(b) by 961 days.

(21) Appl. No.: 17/709,456

(22) Filed: Mar. 31, 2022

(65) Prior Publication Data

US 2022/0316201 A1 Oct. 6, 2022

(30) Foreign Application Priority Data

Apr. 1, 2021 (DE) ..... 20 2021 101 776.7

(51) Int. Cl.
*E04B 1/00* (2006.01)
*E04B 1/78* (2006.01)
(Continued)

(52) U.S. Cl.
CPC ..... *E04B 1/0038* (2013.01); *E04B 1/78* (2013.01); *E04B 5/16* (2013.01); *E04B 2001/7679* (2013.01)

(58) Field of Classification Search
CPC ... E04B 5/16; E04B 5/32; E04B 5/324; E04B 1/41; E04B 1/4107; E04B 1/4157;
(Continued)

(56) References Cited

U.S. PATENT DOCUMENTS 8,733,052 B2 * 5/2014 Froehlich ..... E04B 1/0038 52/407.3
12,012,743 B2 * 6/2024 Keller ..... E04B 1/0038
(Continued)

FOREIGN PATENT DOCUMENTS

DE 20 2021 000 466 * 6/2002
DE 202021000466 U1 * 6/2021 ..... E04B 1/0038
(Continued)

OTHER PUBLICATIONS

Translation of DE202021000466 (Year: 2021).*

*Primary Examiner* — Jessica L Laux
(74) *Attorney, Agent, or Firm* — Gudrun E. Huckett

(57) ABSTRACT

A device for thermally insulating, force-transmitting retrofitting of a second load-bearing construction element to a first load-bearing construction element has an insulation body to be arranged in a construction joint between the construction elements. The insulation body has a casing filled with insulation material. The casing has a first longitudinal side to be arranged at the first construction element and an oppositely positioned second longitudinal side. The casing has a length direction, a transverse direction, and an upright direction perpendicular to length direction and transverse direction. A compression element for transmitting compressive forces between first and second construction elements extends from the first to the second longitudinal side. First tension rods project into the casing at the first longitudinal side and second tension rods project into the casing at the second longitudinal side. A connection arrangement is arranged in the casing for force-transmittingly connecting the first and second tension rods.

16 Claims, 3 Drawing Sheets

(51) Int. Cl.
*E04B 5/16* (2006.01)
*E04B 1/76* (2006.01)

(58) Field of Classification Search
CPC . E04B 1/388; E04B 1/61; E04B 1/612; E04B 1/68; E04B 1/6804; E04B 1/6807; E04B 1/0038
See application file for complete search history.

(56) References Cited

U.S. PATENT DOCUMENTS

| | | | | |
|---|---|---|---|---|
| 12,049,751 | B2 * | 7/2024 | Poveda | E04B 5/36 |
| 2008/0010913 | A1 * | 1/2008 | Fritschi | E04B 1/0038 52/167.1 |
| 2019/0017256 | A1 * | 1/2019 | Michiels | E05B 65/06 |

FOREIGN PATENT DOCUMENTS

| | | | | |
|---|---|---|---|---|
| EP | 3 613 910 | | 2/2020 | |
| GB | 2567685 | | 4/2019 | |
| KR | 101462801 | | 11/2014 | |
| WO | 2017/086777 | | 5/2017 | |
| WO | WO-2020109762 | A1 * | 6/2020 | E04B 1/0038 |

* cited by examiner

DEVICE FOR THERMALLY INSULATING, FORCE-TRANSMITTING RETROFITTING OF A SECOND LOAD-BEARING CONSTRUCTION ELEMENT TO A FIRST LOAD-BEARING CONSTRUCTION ELEMENT AND STRUCTURE WITH SUCH A DEVICE

BACKGROUND OF THE INVENTION

The invention relates to a device for thermally insulating, force-transmitting retrofitting of a second load-bearing construction element to a first load-bearing construction element, in particular of a building ceiling to a balcony slab, as well as a structure with such a device.

WO 2017/086777 A1 discloses a device for retrofitting a prefabricated balcony to a building. For connecting the tension rods of balcony slab and building, at the top side of the balcony a recess is provided in which the tension rods are connected to each other.

The present invention has the object of providing a device for thermally insulating, force-transmitting retrofitting of a second load-bearing construction element to a first load-bearing construction element such that the device comprises an advantageous configuration. A further object of the present invention resides in providing a structure with such a device.

SUMMARY OF THE INVENTION

In accordance with the invention, this is achieved by a device for thermally insulating, force-transmitting retrofitting of a second load-bearing construction element to a first load-bearing construction element, in particular a balcony slab to a building ceiling, wherein the device comprises an insulation body for installation in a construction joint between the first construction element and the second construction element, wherein the insulation body is formed by a shape-stable casing filled with insulation material, wherein the casing comprises a first longitudinal side provided for arrangement at the first construction element and an oppositely positioned second longitudinal side, wherein the casing comprises a length direction, a transverse direction extending perpendicularly to the length direction and extending from the first longitudinal side to the second longitudinal side, and an upright direction extending perpendicularly to the length direction and perpendicularly to the transverse direction, wherein the device comprises at least one compression element for transmitting compressive forces between the first construction element and the second construction element that extends at least from the first longitudinal side to the second longitudinal side of the casing, wherein the device comprises first tension rods and second tension rods as well as a connection arrangement for a force-transmitting retrofitting connection of the second tension rods to the first tension rods, wherein the first tension rods project at the first longitudinal side into the casing, wherein the second tension rods project at the second longitudinal side into the casing, and wherein the connection arrangement is arranged in the casing.

In accordance with the present invention, the object is solved by a structure comprising a first load-bearing construction element and a second load-bearing construction element of concrete and a device for thermally insulating force-transmitting retrofitting of the second load-bearing construction element to the first load-bearing construction element, wherein the device comprises an insulation body for arrangement in a construction joint between the first construction element and the second construction element, wherein the insulation body is formed by a shape-stable casing filled with an insulation material, wherein the casing comprises a first longitudinal side provided for arrangement at the first construction element and an oppositely positioned second longitudinal side, wherein the casing comprises a length direction, a transverse direction extending perpendicularly to the length direction and extending from the first longitudinal side to the second longitudinal side, and an upright direction extending perpendicularly to the length direction and perpendicularly to the transverse direction, wherein the device comprises at least one compression element for transmitting compressive forces between the first construction element and the second construction element that extends at least from the first longitudinal side to the second longitudinal side of the casing, wherein the device comprises first tension rods and second tension rods as well as a connection arrangement for a force-transmitting retrofitting connection of the second tension rods to the first tension rods, wherein the first tension rods project at the first longitudinal side into the casing, wherein the second tension rods project at the second longitudinal side into the casing, and wherein the connection arrangement is arranged in the casing.

It is provided that the first tension rods project at the first longitudinal side of the casing into the casing, that the second tension rods project at the second longitudinal side into the casing, and that the connection arrangement is arranged in the casing. Since the connection arrangement is arranged in the casing, the connection arrangement, by closing the casing, can be protected easily from environmental influences. At the same time, a pleasing visual appearance is obtained because the connection arrangement, after closing the casing, is not visible from the exterior. A later filling of the region of the connection arrangement, for example, with a quick-set mortar or the like, can be dispensed with. In this way, mounting at the construction site is simplified. The arrangement of a cutout in the first or the second construction element in which the connection arrangement is to be arranged can be dispensed with. In this way, an adverse effect on the appearance of the first or second construction element is avoided.

Due to the arrangement in the casing, when using a fire-retardant material as an insulation material and/or as a material for the casing, a fire protection of the connection arrangement can be achieved at the same time. The tension rods which are projecting at the first longitudinal side into the casing are advantageously provided for embedding in the first construction element and the tension rods projecting at the second longitudinal side into the casing are advantageously provided for embedding in the second construction element.

Due to the arrangement of the connection arrangement in the casing, a sufficient corrosion protection of the connection arrangement and of the sections of the tension rods projecting into the casing can be ensured in a simple manner. An additional corrosion protection can be dispensed with.

The tension rods are provided to introduce forces into the concrete of the construction elements. The length of the tension rods required for this purpose is calculated based on the forces to be transmitted. For the calculation of the length of the tension rods, only those sections of the tension rods can be completely taken into account which are embedded well in concrete of a sufficient strength. In case of a subsequent filling of cutouts with a concrete grout, the strength of the concrete grout and its connection to the tension rods frequently cannot be ensured to a satisfactory degree so that tension rod sections extending in the cutouts cannot be taken into account in the calculation or cannot be taken into account in the calculation to the same degree compared to tension rod sections which project into cast-in-place concrete or into concrete produced in a prefabrication plant.

Due to the arrangement of the connection arrangement in the casing, the entire length of the tension rods located completely outside of the casing can be embedded during manufacture of the construction elements in the first or the second construction element and no subsequent filling of a cutout with concrete grout, such as mortar, must be carried out; therefore, the entire length of the tension rods extending outside of the casing can be taken into account here for calculating the required length of the tension rods, in particular for calculating the overlap length. In this way, only a reduced length of the tension rods is needed.

Advantageously, the first tension rods and the second tension rods are arranged in a common plane that is perpendicular to the upright direction. In this way, a beneficial force introduction is achieved. At the same time, the connection of the tension rods in the casing is possible in a simple way because no vertical offset between the tension rods must be compensated.

Particularly advantageously, the connection arrangement comprises a connection plate which is arranged in the casing and at which the first tension rods and the second tension rods are fixed. In an advantageous embodiment variant, the connection plate is arranged at a longitudinal side of the casing inside the casing. Particularly advantageously, the connection plate is arranged at the longitudinal side of the casing which is closer to the balcony slab. Preferably, the tension rods, which are embedded in the building and which project through the longitudinal side of the casing positioned remote from the balcony slab, are connected fixedly to the connection plate, for example, by weld connections. When mounting the balcony slab, preferably the tension rods of the balcony slab are pushed through openings of the connection plate and are fixed by screw connections, preferably by means of nuts. For this purpose, the connection arrangement advantageously comprises a screw connection. The openings of the connection plate are advantageously designed to be so large that a tolerance compensation between the tension rods of the building and the tension rods of the balcony slab is possible.

For a simple assembly, it is advantageously provided that the casing comprises at least one closable access opening through which the connection arrangement is accessible. Particularly preferred, the access opening is designed to be reclosable so that the connection arrangement is accessible again after mounting by opening the casing once again.

A simple configuration results when the access opening extends across the entire length and the entire width of the casing. However, it can also be provided that the access opening extends only across the region of the casing that overlaps the connection arrangement. In an alternative configuration, the access opening can extend only across the region of the threaded connections. It can also be provided that the casing comprises a plurality of access openings through which only one or a plurality of thread connections are accessible, respectively.

Preferably, the casing is filled with mineral wool as insulation material. Advantageously, the insulation material is introduced at least partially after the first and second tension rods have been connected to each other in the casing. A simple configuration results when the casing is comprised of plastic material. Particularly preferred, the casing is produced from extrusion-molded profiles. In this way, a simple and economical manufacture of the casing is possible. Preferably, the casing comprises a base member and at least one cover that is connectable to the base member. The cover is preferably detachably connected to the base member. The cover can be connected to the base member, for example, by a snap connection, a locking action, or clamping. A different type of connection of cover and base member can be advantageous also. It can be alternatively provided to non-detachably connect the cover to the base member, for example, by an adhesive connection.

The casing can be open at its end faces that are positioned perpendicularly to the length direction. This is in particular advantageous when a plurality of casings are arranged so as to adjoin each other at the end faces. In particular in case of casings which close off an insulation joint in length direction, it is advantageously provided that the casing is closed at least at one end face. For this purpose, a further cover can be provided. In transverse direction and in upright direction, the casing is advantageously of a closed configuration.

For transmitting the shear forces, advantageously at least one support for vertically supporting the construction element is arranged at the second longitudinal side of the casing. In this way, a simple retrofitting mounting of the second construction element at the first construction element is possible. Retrofitting means in this context that the second construction element, for example, the balcony slab, is already completely manufactured and the tension rods are embedded in the balcony slab prior to the balcony slab being fixed at the first construction element. In this way, a simple and economical manufacture of the building is possible. Crane time can be minimized by this type of manufacture.

Advantageously, at least one shear rod projects through the casing. In a preferred configuration, the at least one shear rod is fixed at the support for vertically supporting the second construction element. However, a different type of connection of the shear rod can be advantageous also.

For a structure, it is provided that the structure comprises a first load-bearing construction element of concrete and a second load-bearing construction element of concrete as well as a device for connecting the second load-bearing construction element to the first load-bearing construction element. Advantageously, the device comprises two units that are connectable to each other, namely a unit to be fixed at the first construction element as well as a second unit to be fixed at the second construction element which after, manufacture of the construction elements, can be connected to each other. Preferably, first tension rods are embedded in the first construction element and second tension rods are embedded in the second construction element. The insulation body is preferably fixed at the first construction element. By connecting the tension rods to each other, the second construction element can be fixed at the first construction element.

BRIEF DESCRIPTION OF THE DRAWING

Embodiments of the invention will be explained in the following with the aid of the drawing.

DESCRIPTION OF THE PREFERRED EMBODIMENTS

Figure 1:
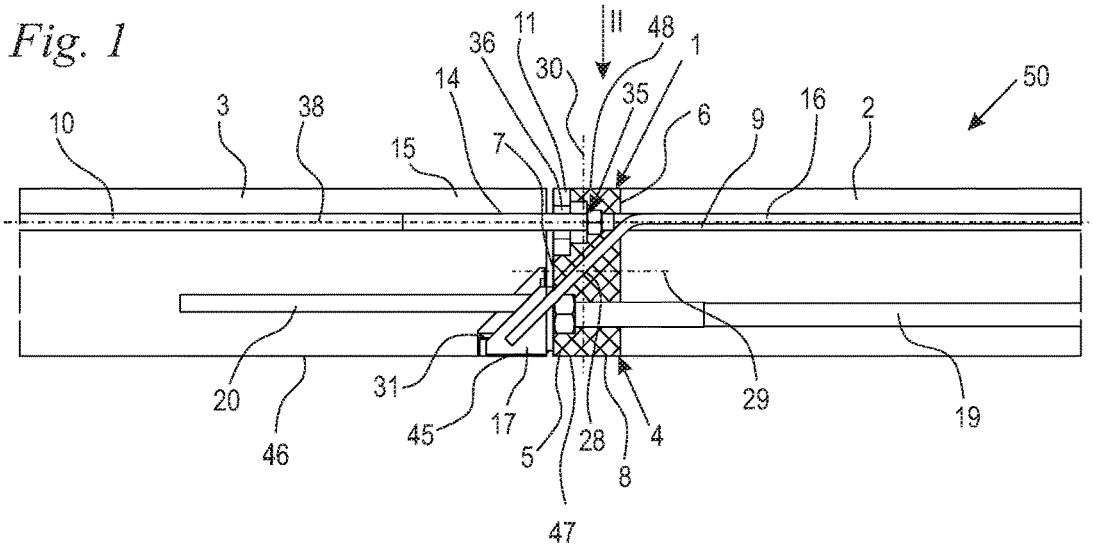
FIG. 1 is a schematic section illustration of a structure.

FIG. 1 shows schematically a detail of a structure 50. The structure 50 comprises a first construction element 2, in the embodiment a building ceiling, and a second construction element 3, in the embodiment a balcony slab. The second construction element 3 is joined by means of a thermally insulating component 1 to the first construction element 2 in a thermally insulating and force-transmitting manner. The load-bearing construction elements 2 and 3 are made of concrete, in the embodiment of steel-reinforced concrete. The load-bearing construction element 3 has been fixed after its manufacture to the first load-bearing construction element 2. In this way, the load-bearing construction element 3 can be manufactured, for example, in a prefabrication plant, with high quality and can be fixed very quickly to the construction element 2 at the construction site so that crane time can be shortened and therefore production costs can be reduced. The second construction element 3 can be, for example, a balcony that is produced as a prefabricated part.

The thermally insulating component 1 comprises an insulation body 5 which is arranged in a construction joint 4 between the first construction element 2 and the second construction element 3. The insulation body 5 comprises a first longitudinal side 6 arranged at the first construction element 2. The second oppositely positioned longitudinal side 7 extends next to the second construction element 3. In the embodiment, a narrow gap is formed between the insulation body 5 and the second construction element 3. However, it can also be provided that the second construction element 3 contacts the insulation body 5.

Figure 2:
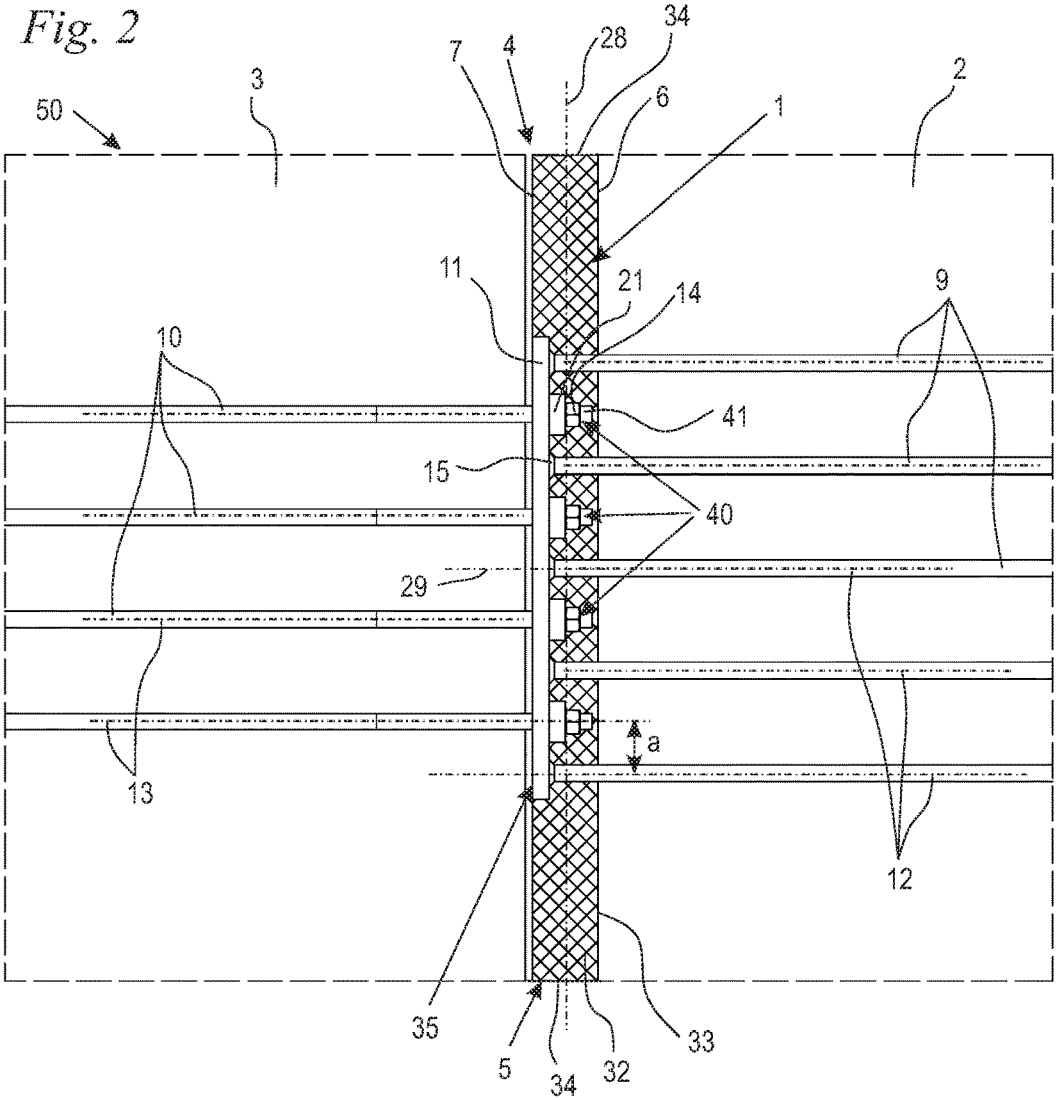
FIG. 2 is a schematic detail illustration of the tension force-transmitting means of the structure according to FIG. 1 in a viewing direction of arrow II in FIG. 1.

As illustrated in FIG. 2, the insulation body 5 comprises a casing 33 which is filled with insulation material 32. Advantageously, the casing 33 is made of plastic material. The casing 33 is in particular produced of plastic material from one or a plurality of extrusion-molded profiles. The insulation material 32 is preferably mineral wool. However, a different insulation material can be provided also. The casing 33 is advantageously designed to be closed at its longitudinal sides 6 and 7.

Advantageously, one or a plurality of casings 33 extend across the entire length of the construction joint 4. Neighboring casings 33 are advantageously arranged such that they adjoin each other with their end faces 34; in case of an angled course of the construction joint 4, they are adjoined in such a way that an end face 34 of one casing 33 adjoins a longitudinal side 6 of an adjoining casing 33. The end faces 34 of the casing 33 are illustrated also in the FIGS. 7 and 8.

The casing 33 comprises a length direction 28 which is oriented in length direction of the construction joint 4. The length direction 28 extends preferably horizontally in the mounted state. The end faces 34 extend transversely, in particular perpendicularly, to the length direction 28. The casing 33 comprises an upright direction 30, as illustrated in FIG. 1, which extends perpendicularly to the length direction 28. The upright direction 30 extends preferably vertically in the mounted state. The casing 33 comprises a transverse direction 29 illustrated in FIG. 1 which extends from the first longitudinal side 6 to the oppositely positioned second longitudinal side 7. The transverse direction 29 is oriented perpendicularly to the length direction 28 and perpendicularly to the upright direction 30. The transverse direction 29 extends in the mounted state preferably horizontally.

As illustrated in FIG. 1, the casing 33 comprises a bottom side 8 which connects the longitudinal sides 6 and 7 and is oriented in length direction 28 and further comprises a top side 47 connecting the longitudinal sides 6 and 7 and extending in the length direction 28. In the mounted state, the top side 47 is arranged above the bottom side 8. The casing 33 is advantageously of a closed configuration at the top side 47 and at the bottom side 8. At the end faces 34 extending transversely to the length direction 28, the casing 33 can be embodied open or closed.

The thermally insulating component 1 forms with additional elements a device for force-transmitting attachment of the second construction element 3 to the first construction element 2. The device is comprised of the thermally insulating component 1 that is fixed at the first construction element 2 as well as additional means for force transmission which are arranged at the second construction element 3. The means for force transmission which are arranged at the second construction element 3 are connected advantageously detachably to the means for force transmission that are arranged at the first construction element 2. In this way, a retrofitting joining of the second construction element 3 at the first construction element 2 is possible.

For tension force transmission between the construction elements 2 and 3, the device comprises first tension rods 9 that are embedded in the first construction element 2 as well as second tension rods 10 that are embedded in the second construction element 3. The tension rods 9 and 10 are connected to each other by a connection arrangement 35 in a force-transmitting manner. The connection arrangement 35 is arranged in the casing 33. The first tension rods 9 project through the first longitudinal side 6 into the casing 33. The second tension rods 10 project through the second longitudinal side 7 into the casing 33.

In the embodiment, the connection arrangement 35 comprises a connection plate 11. The first tension rods 9 are fixedly connected to the connection plate 11, in the embodiment by weld connections 15 (FIG. 2). In the embodiment, the connection plate 11 is arranged in the casing 33 at the inner side of the second longitudinal side 7. In this way, a space-saving arrangement is provided, and screw connections 40 of the second tension rods 10 are easily accessible. The second tension rods 10 are screw-connected to the connection plate 11. The connection plate 11 comprises openings 36 (FIG. 1) through which the second tension rods 10 project into the interior of the casing 33. The second tension rods 10 comprise threaded sections 41 at their ends projecting into the casing 33. The threaded sections 41 together with the fastening nuts 14 screwed onto the threaded sections 41 form screw connections 40. By means of the screw connections 40, the second tension rods 10 are connected to the connection plate 11. At the side of the connection plate 11 that is arranged so as to face away from the second longitudinal side 7, a respective fastening nut 14 is screwed onto a threaded section 41 of each tension rod 10.

In the embodiment, a washer 21 is arranged between the fastening nuts 14 and the connection plate 11, respectively.

The first tension rods 9 and the second tension rods 10 project on opposite sides away from the connection plate 11. The tension rods 9 and 10 end in the interior of the casing 33.

In an alternative embodiment, it can be provided that the first tension rods 9 as well as the second tension rods 10 are connected by screw connections 40 to the connection plate 11. A different force-transmitting connection of the tension rods 9 and 10 can be advantageous also. The connection arrangement 35 is embodied in this context such that the tension rods 9 and 10 can be connected to each other after producing the construction elements 2 and 3.

For transmitting compressive forces and shear forces, a support 17 is arranged at the second construction element 2. In the embodiment, the support 17 is designed as a support angle bracket. The support 17 forms advantageously a part of the thermally insulating component 1 and is in particular secured captively at the casing 33. The support 17 is connected fixedly to shear rods 16. The shear rods 16 are embedded in the concrete of the first construction element 2 and therefore connected force-transmittingly to the first construction element 2. The support 17 is supported in horizontal direction on at least one first compression rod 19 embedded in the first construction element 2. The first compression rod 19 extends from the second longitudinal side 7 through the first longitudinal side 6 of the casing 33 into the first construction element 2. The first compression rod 19 forms a compression element. A different configuration of the compression element can also be advantageous. It can be provided that the support 17 is connected fixedly to the at least one compression rod 19.

In the embodiment, the second construction element 3 has embedded therein a support angle bracket 31 that is resting on the support 17. By means of the support angle bracket 31, the second construction element 3 introduces compressive forces acting in horizontal direction as well as shear forces acting in upright direction into the support 17. The support angle bracket 31 is connected to at least one second compression rod 20. The at least one second compression rod 20 is embedded in the second construction element 3. A different kind of compressive force introduction into the second construction element can be advantageous also.

The first tension rods 9 comprise longitudinal axes 12 and the second tension rods 10 comprise longitudinal axes 13, as illustrated in FIG. 2. As shown in FIG. 1, the first tension rods 9 and the second tension rods 10 are arranged at the same level. The longitudinal axes 12 and 13 are positioned in a common horizontally extending plane 38. The plane 38 extends parallel to the length direction 28 and parallel to the transverse direction 29. The plane 38 extends perpendicularly to the upright direction 30. The tension rods 9 and 10 are arranged displaced relative to each other in the plane 38. As shown in FIG. 2, the longitudinal axes 12 and 13 of neighboring tension rods 9 and 10 comprise an offset a measured in length direction 28 relative to each other in the embodiment.

The bottom side 8 of the casing 33 extends approximately in the same plane as a bottom side 45 of the support 17 and a bottom side 46 of the second construction element 3.

Figure 3:
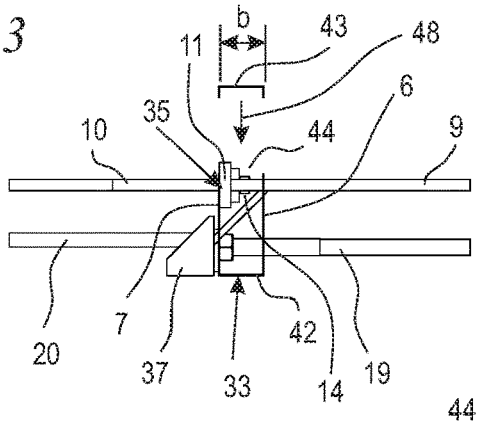
FIG. 3 is a schematic side view of the device for connecting the two construction elements with open casing.
Figure 4:
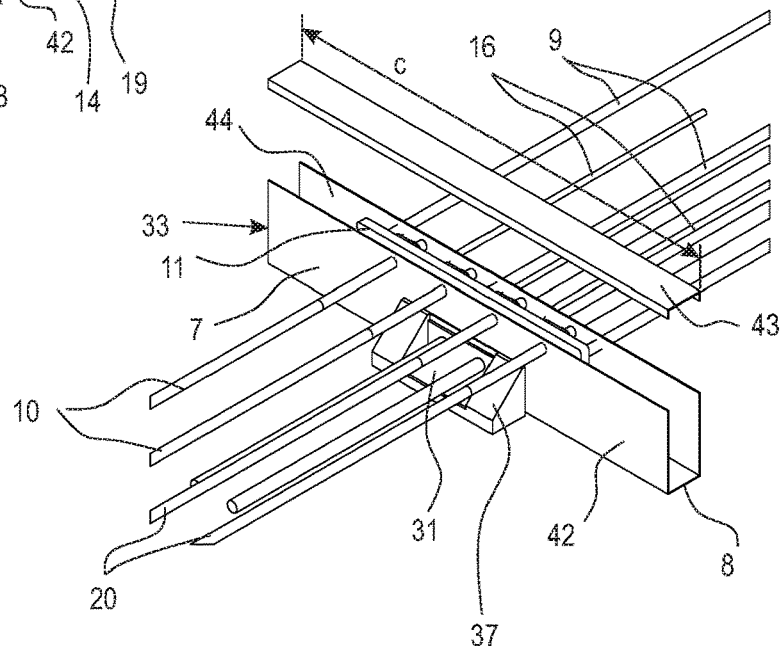
FIG. 4 is a schematic perspective illustration of the device of FIG. 3 with open casing.
Figure 5:
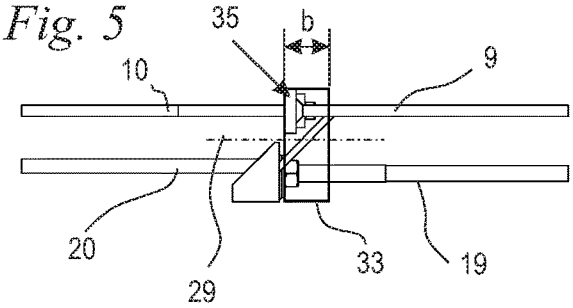
FIG. 5 is a schematic side view of the device of FIG. 3 and FIG. 4 with closed casing.

FIGS. 3 to 6 show the configuration of the casing 33 in detail. As shown in FIGS. 3 and 4, the casing 33 is formed by a base member 42 and a cover 43. In FIGS. 3 and 4, the cover 43 is illustrated removed from the base member 42. The cover 43 can be placed in the direction of arrow 48 onto the base member 42 and can be connected thereto. In the state illustrated in FIGS. 3 and 4 with removed cover 43, an access opening 44 is open. Via the access opening 44, the connection arrangement 35 is accessible from the exterior of the casing 33. The second tension rods 10 can be pushed through the openings in the connection plate 11 and subsequently fixed by means of fastening nuts 14. The fastening nuts 14 are accessible from the exterior through the access opening 44 in this context. After fixation of the fastening nuts 14, the base member 42 can be filled with insulation material, preferably with mineral wool, and subsequently the cover 43 can be placed thereon and secured. The cover 43 can be fixed at the base member 42 in particular by a detachable connection, for example, by a snap connection, a clamping connection or a locking connection. The detachable connection is advantageously designed such that the cover 43 can be removed again without causing destruction. A different connection of cover 43 and base member 42 can be provided, for example, an adhesive connection.

Figure 6:
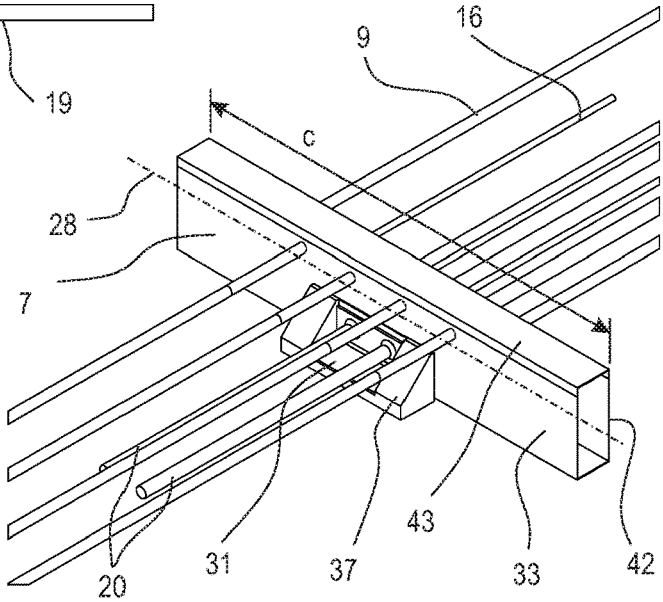
FIG. 6 is a schematic perspective illustration of the device of FIG. 5 with closed casing.
Figure 7:
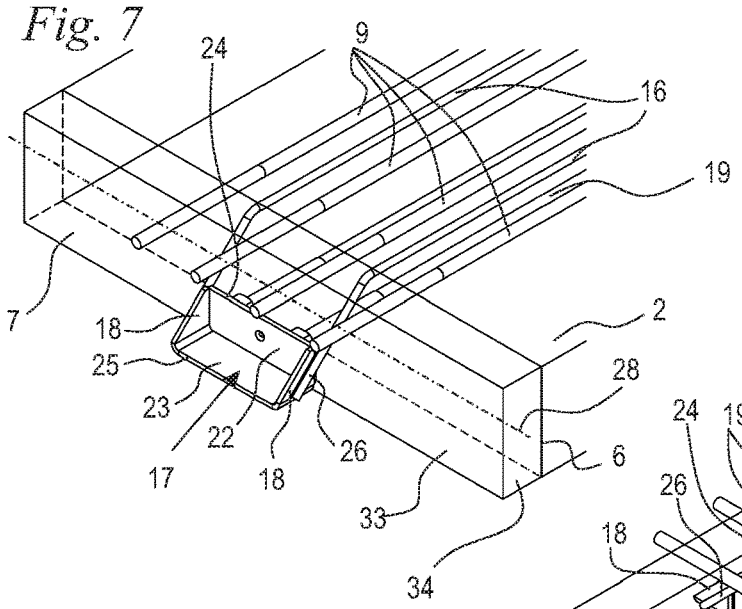
FIG. 7, FIG. 8, FIG. 9, and FIG. 10 show different schematic perspective illustrations of the first construction element and of the elements for transmitting compressive forces and shear forces of the device for connecting the construction elements, wherein these elements for transmitting compressive forces and shear forces are arranged at the first construction element.
Figure 8:
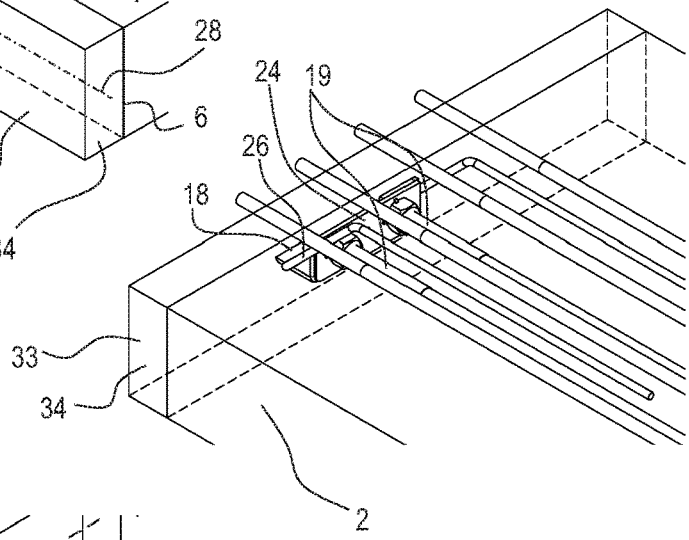

As also shown in FIGS. 3 and 4, at the second longitudinal side 7 of the casing 33, a formwork member 37 is arranged which is embedded in the second construction element 3. The formwork member 37 forms cutouts for cheeks 18 of the support 17 (FIG. 7). The support angle bracket 31 is resting at the formwork member 37, as illustrated in FIG. 4. As shown in FIGS. 4 and 6, two second compression rods 20 are fixed at the support angle bracket 31 in the embodiment. A different number of second compression rods 20 can be provided also.

As illustrated in FIGS. 3 to 6, the access opening 44 extends across the entire width b of the casing 33 measured in transverse direction 29 and the entire length c of the casing 33 measured in length direction 28. As also shown in FIGS. 4 and 6, the casing 33 is designed open at end faces 34 which are perpendicular to the length direction 28. It can also be provided that the casing 33 is designed to be completely closed in the closed state.

In the embodiment, the base member 42 is U-shaped and forms the bottom side 8 as well as the longitudinal sides 6 and 7 of the casing 33. The cover 43 is also U-shaped in cross section, wherein the legs of the cover 43 are short.

FIGS. 7 to 10 show the thermally insulating component 1 at the first construction element 2 in detail. The first tension rods 9 are only schematically illustrated and without connection arrangement 35. The connection plate 11, at which the tension rods 9 end in the casing 33, is not illustrated.

Figure 9:
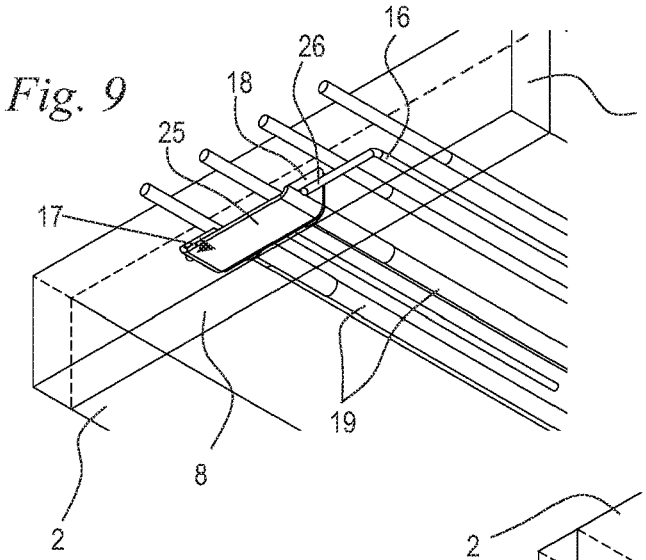
Figure 10:
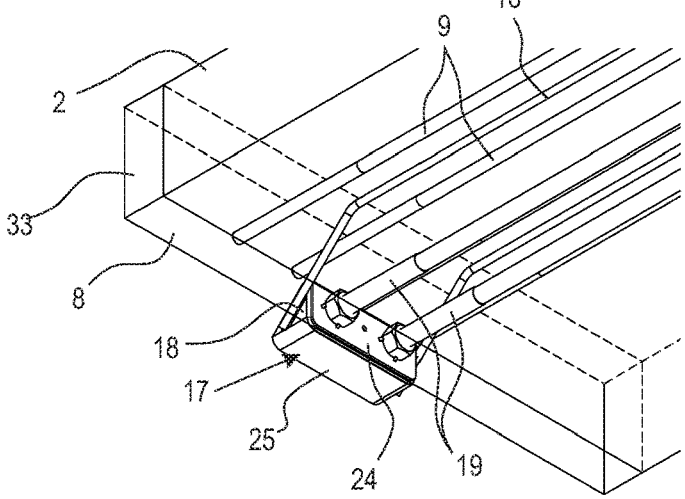

The support 17 of the thermally insulating component 1 comprises two legs 24 and 25 which are oriented at a right angle to each other in the embodiment. The legs 24 and 25 extend parallel to the length direction 28 of the casing 33. The first leg 24 extends parallel to the upright direction 30. The first leg 24 is advantageously vertically oriented in the mounted state at the structure 50. At the side which is facing away from the casing 33, the first leg 24 forms a support surface 22 for transmitting compressive forces. The second leg 25 extends parallel to the transverse direction 29 and is advantageously horizontally oriented in the mounted state. A support surface 23 for transmitting shear forces is formed at the second leg 25 at the upwardly facing side in the mounted state. As also illustrated in FIGS. 9 and 10, the second leg 25 of the support 17 extends near the bottom side 8 of the insulation body 5. The second construction element 3 can be placed onto the support surface 23 and then fixed by means of the screw connections 40 at the first construction element 2. The space which is defined by the two legs 24 and 25 is closed at the ends of the support 17 by cheeks 18 which are extending transversely to the length direction 28.

The shear rods 16 are embedded in the first construction element 2 and comprise a section 26 which is arranged at a slant to the upright direction 30 and at a slant to the transverse direction 29. In the mounted state, the slanted section 26 descends from the first construction element 2 toward the second construction element 3. The slanted sections 26 of the two shear rods 16 extends at the exterior sides of the cheeks 18 facing away from each other. Each slanted section 26 is secured directly at a cheek 18, in the embodiment by welding. The slanted section 26 of the at least one shear rod 16 projects through the insulation body 5.

The support 17 in the illustrated embodiment is arranged outside of the casing 33, namely at the longitudinal side 7 of the casing 33 which is facing away from the first longitudinal side 6. The support 17 projects therefore into the region of the second construction element 3. At the side of the first leg 24 which is facing the casing 33, the first compression rods 19 are secured at the first leg 24. The compression rods 19 are designed as comparatively long straight rods which are embedded in the concrete of the first construction element 2 for compressive force transmission. The compression rods 19 can be screwed, welded or fastened in a different way to the support 17. A different configuration of the elements for compressive force transmission can be advantageous also.

Advantageously, the support 17 is comprised of metal. The support 17 is in particular formed of sheet metal, including the at least one cheek 18, preferably formed of at least two sheet metal parts connected to each other.

In an alternative embodiment variant, not illustrated, it can also be provided that the tension rods 10 as well as the tension rods 9 are fixed at the connection plate 11 by fastening nuts 14. Advantageously, a washer 21 is arranged between each fastening nut 14 and the connection plate 11. The washers 21 can however also be dispensed with.

The specification incorporates by reference the entire disclosure of German priority document 20 2021 101 776.7 having a filing date of Apr. 1, 2021.

While specific embodiments of the invention have been shown and described in detail to illustrate the inventive principles, it will be understood that the invention may be embodied otherwise without departing from such principles.

What is claimed is:

1. A device for thermally insulating, force-transmitting retrofitting of a second load-bearing construction element to a first load-bearing construction element, the device comprising:

an insulation body configured to be arranged in a construction joint between the first load-bearing construction element and the second load-bearing construction element, wherein the insulation body comprises a shape-stable casing filled with an insulation material, wherein the casing comprises a first longitudinal side configured to be arranged at the first load-bearing construction element and an oppositely positioned second longitudinal side, wherein the casing comprises a length direction, a transverse direction extending perpendicularly to the length direction and extending from the first longitudinal side to the second longitudinal side, and an upright direction extending perpendicularly to the length direction and perpendicularly to the transverse direction;

at least one compression element configured to transmit compressive forces between the first load-bearing construction element and the second load-bearing construction element and extending at least from the first longitudinal side of the casing to the second longitudinal side of the casing;

first tension rods projecting into the casing at the first longitudinal side of the casing, wherein the first tension rods each comprise a first longitudinal axis;

second tension rods projecting into the casing at the second longitudinal side of the casing, wherein the second tension rods each comprise a second longitudinal axis;

a connection arrangement arranged completely enclosed by the casing and configured to force-transmittingly connect the second tension rods to the first tension rods;

wherein the first longitudinal axis and the second longitudinal axis of one of the first tension rods and of a neighboring one of the second tension rods, which are connected force-transmittingly to each other by the connection arrangement, comprise an offset greater than zero relative to each other, wherein the offset is measured in the length direction of the casing.

2. The device according to claim 1, wherein the first tension rods and the second tension rods are arranged in a common plane extending perpendicularly to the upright direction.

3. The device according to claim 1, wherein the connection arrangement comprises a connection plate arranged in the casing, wherein the first tension rods and the second tension rods are fixed at the connection plate.

4. The device according to claim 3, wherein the connection plate is arranged inside the casing at the first longitudinal side or the second longitudinal side.

5. The device according to claim 1, wherein the casing comprises at least one closable access opening through which the connection arrangement is accessible.

6. The device according to claim 5, wherein the access opening extends across an entire length measured in the length direction of the casing and an entire width measured in the transverse direction of the casing.

7. The device according to claim 1, wherein the insulation material is mineral wool.

8. The device according to claim 1, wherein the casing is comprised of plastic material.

9. The device according to claim 1, wherein the casing comprises a base member and at least one cover connectable to the base member.

10. The device according to claim 9, wherein the cover is detachably connectable to the base member.

11. The device according to claim 1, further comprising at least one support arranged at the second longitudinal side of the casing, wherein the at least one support is configured to vertically support the second load-bearing construction element.

12. The device according to claim 1, further comprising at least one shear rod extending through the casing.

13. The device according to claim 1, wherein one of the first load-bearing construction element and the second load-bearing construction element is a building ceiling and the other one of the first load-bearing construction element and the second load-bearing construction element is a balcony slab.

14. The device according to claim 1, wherein the connection arrangement is configured to permit fixation of the second load-bearing construction element, after manufacture thereof, at the first load-bearing construction element.

15. A device for thermally insulating, force-transmitting retrofitting of a second load-bearing construction element to a first load-bearing construction element, the device comprising:

an insulation body configured to be arranged in a construction joint between the first load-bearing construction element and the second load-bearing construction element, wherein the insulation body comprises a shape-stable casing filled with an insulation material, wherein the casing comprises a first longitudinal side configured to be arranged at the first load-bearing construction element and an oppositely positioned second longitudinal side, wherein the casing comprises a length direction, a transverse direction extending perpendicularly to the length direction and extending from the first longitudinal side to the second longitudinal side, and an upright direction extending perpendicularly to the length direction and perpendicularly to the transverse direction;

at least one compression element configured to transmit compressive forces between the first load-bearing construction element and the second load-bearing construction element and extending at least from the first longitudinal side of the casing to the second longitudinal side of the casing;

first tension rods projecting into the casing at the first longitudinal side of the casing;

second tension rods projecting into the casing at the second longitudinal side of the casing;

a connection arrangement arranged completely enclosed by the casing and configured to force-transmittingly connect the second tension rods to the first tension rods;

wherein the connection arrangement comprises at least one screw connection, wherein the screw connection comprises at least one threaded section arranged inside the casing.

16. A structure comprising:

a first load-bearing construction element comprised of concrete and a second load-bearing construction element comprised of concrete;

a device for thermally insulating, force-transmitting retrofitting of the second load-bearing construction element to the first load-bearing construction element, the device comprising:

an insulation body configured to be arranged in a construction joint between the first load-bearing construction element and the second load-bearing construction element, wherein the insulation body comprises a shape-stable casing filled with an insulation material, wherein the casing comprises a first longitudinal side configured to be arranged at the first load-bearing construction element and an oppositely positioned second longitudinal side, wherein the casing comprises a length direction, a transverse direction extending perpendicularly to the length direction and extending from the first longitudinal side to the second longitudinal side, and an upright direction extending perpendicularly to the length direction and perpendicularly to the transverse direction;

at least one compression element configured to transmit compressive forces between the first load-bearing construction element and the second load-bearing construction element and extending at least from the first longitudinal side of the casing to the second longitudinal side of the casing;

first tension rods projecting into the casing at the first longitudinal side of the casing, wherein the first tension rods are embedded in the concrete of the first load-bearing construction element and thus force-transmittingly connected to the first load-bearing construction element;

second tension rods projecting into the casing at the second longitudinal side of the casing, wherein the second tension rods are embedded in the concrete of the second load-bearing construction element and thus force-transmittingly connected to the second load-bearing construction element;

a connection arrangement arranged completely enclosed by the casing and configured to force-transmittingly connect the second tension rods to the first tension rods.

* * * * *